United States Patent [19]

Walter et al.

[11] 4,313,801

[45] Feb. 2, 1982

[54] PROCESS FOR FABRICATING COMPUTER PRINTER CHARACTER BANDS BY ELECTRODEPOSITION

[76] Inventors: Robert J. Walter, 418 Kevin St., Thousand Oaks, Calif. 91360; Kam C. Wong, 6540 Franrivers Ave., Canoga Park, Calif. 91307

[21] Appl. No.: 194,549

[22] Filed: Oct. 6, 1980

[51] Int. Cl.[3] ..... C25D 1/02

[52] U.S. Cl. ..... 204/9; 204/281

[58] Field of Search ..... 204/4, 6, 9, 12, 281

[56] References Cited

U.S. PATENT DOCUMENTS 3,451,916 6/1969 Lapointe ..... 204/281
3,476,657 11/1969 Lundquist ..... 204/12
3,954,568 5/1976 DuPree ..... 204/9

FOREIGN PATENT DOCUMENTS 51-26641 3/1976 Japan ..... 204/9

OTHER PUBLICATIONS

Product Engineering, Jun. 5, 1961, pp. 609–614.
Metal Finishing Guidebook Directory, Jan. 1979, p. 438.

*Primary Examiner*—T. M. Tufariello
*Attorney, Agent, or Firm*—Harry B. Field

[57] ABSTRACT

A process for fabricating character bands 22 for computer printers and the product generated thereby. The process comprises the steps of electrodepositing a binary or ternary nickel alloy onto a cylindrical cathodic mandrel 20, preferably machining away excess backing material 36 so as to leave a smooth surface 38, and separating character band 22 from mandrel 20.

10 Claims, 4 Drawing Figures

Fig. 1
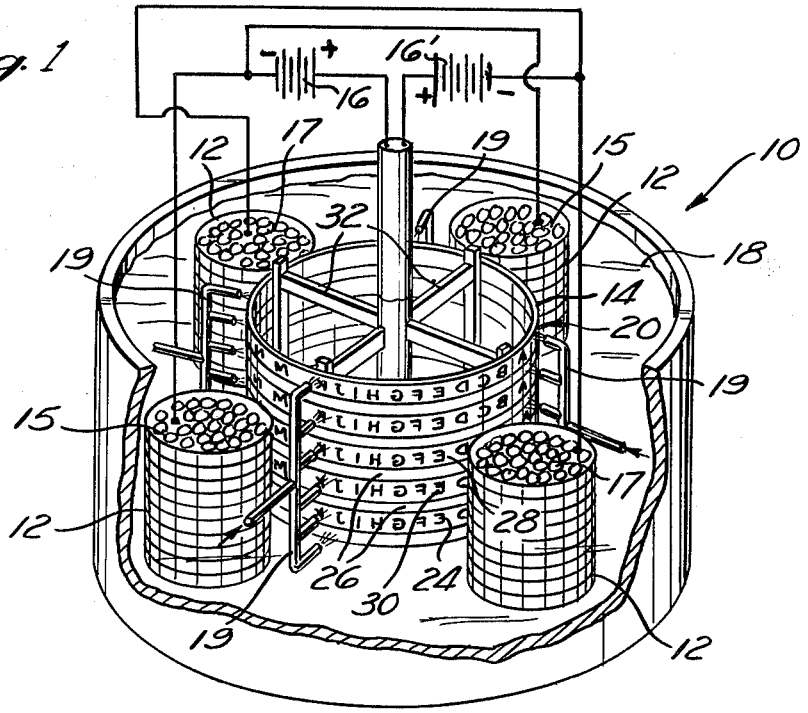
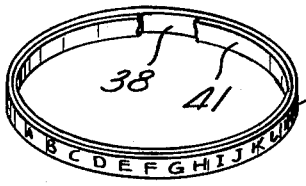
Fig. 2a
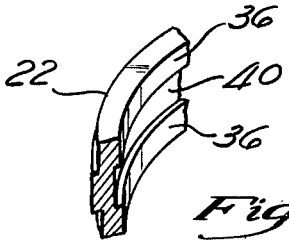
Fig. 2b
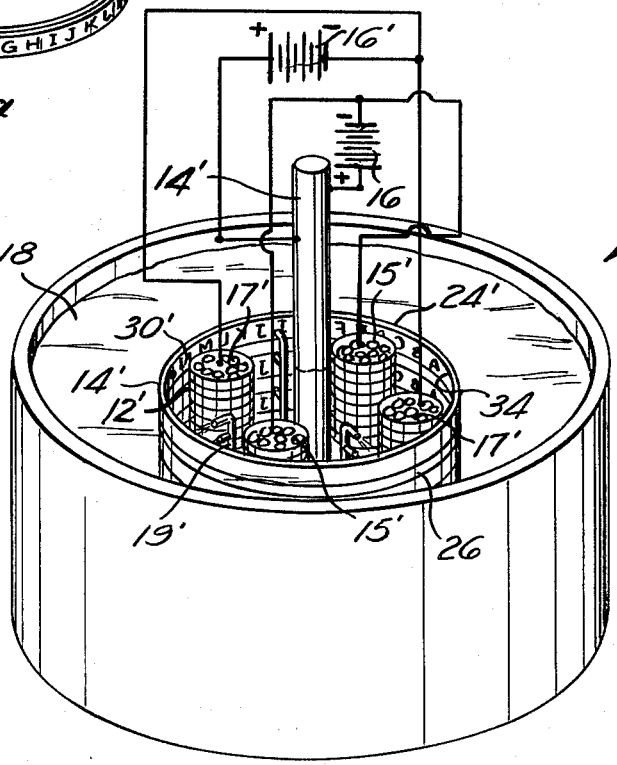
Fig. 3

PROCESS FOR FABRICATING COMPUTER PRINTER CHARACTER BANDS BY ELECTRODEPOSITION

BACKGROUND OF THE INVENTION

1. Field of the Invention

The present invention relates to fabrication of character bands used in computer printers and more specifically to the electrodeposition of binary and ternary nickel alloy character bands and the hardware associated with the fabrication technique.

2. Description of the Prior Art

Computer character bands are the final step in translating electronically stored information into human readable form. But, as in so many instances, it is the translation into a form for human consumption which is the slowest step in the computer process. As a result, scientists have endeavored to make computer printers operate at faster and faster rates resulting in greater and greater stresses on the printing apparatus.

Currently, the character bands are primarily fabricated by electrochemical milling or by photochemical etching of high strength stainless steels. The photochemical etching process generates a better product; however, it is a relatively expensive method because of the intricate lithographic process required. Another problem is that the control of the side slope of the characters is an exceptionally difficult problem. These methods of fabrication introduce many problems including an additional welding step which requires precise band alignment. All of these problems require time and money to correct, cure and, if possible to eliminate.

SUMMARY OF THE INVENTION

Accordingly, there is provided by the present invention a process for fabricating character bands used in computer printers, the hardware associated with said process, and the product generated thereby. The electrodeposition system of the present invention comprises an anode which has at least one nickel terminal and for a binary deposit at least one terminal selected from cobalt, iron, and mangenese. If a ternary alloy is desired, a third terminal selected from one of the remaining two metals would be prepared. The anode is connected to a cathodic mandrel through a conventional power source and an electrolytic solution. In its preferred configuration, the cylindrical cathodic mandrel comprises a plurality of mirror image bands arranged in alternating sequence with electrodeposition insulators. A current is passed through the system causing electrodeposition of the anodic material onto the cathodic mandrel. After deposition, the character band is separated from the mandrel in an appropriate manner and is readied for use.

OBJECTS OF THE INVENTION

Therefore, it is an object of the present invention to provide an electrochemical process for fabricating computer printer character bands.

Another object of the present invention is to provide a process for fabricating character bands having about a 70KSI endurance limit and about a 200KSI ultimate strength.

Yet another object of the present invention is to provide a means for fabricating character bands of binary and ternary nickel alloys.

Still a further object of the present invention is to provide a process for fabricating high strength character bands that are only about 5 mils thick and having a character thickness of about 10 mils.

A further object of the present invention is to provide an inexpensive character band.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic representation of a first electrodeposition system.

FIG. 2*a* is schematic representation of the preferred character band.

FIG. 2*b* is a schematic segment of a character band.

FIG. 3 is a schematic representation of a second electrodeposition system.

The same elements or parts throughout the figures of the drawing are designated by the same reference characters while equivalent elements bear a prime designation.

DESCRIPTION OF THE PREFERRED EMBODIMENTS

In accordance with the present invention there is provided a process for making character bands used in computer printers, the hardware associated with said process, and the product generated thereby.

Turning now to FIG. 1 there is shown one schematic representation of the electrodeposition system generally designated 10. Electrodeposition system 10 comprises anode 12 which is electrically connected to cathode 14 through conventional power source 16, 16' and electrolytic solution 18.

The electrolyte solution 18 contains metal ions of the alloy composition being deposited for producing high strength wear resistant character bands 22 as shown in FIGS. 2*a* and 2*b*. Although many electrodeposited elements and alloys can be used, those of nickel cobalt, nickel iron, nickel mangenese, and ternary alloys of nickel, iron, cobalt and mangenese are preferred and that of nickel cobalt is most preferred. The extremely high fatigue strength of the electrode-posited nickel-cobalt character band 22 is based in part on extremely small grain size achieved by using the electrolyte described herein. These high tensile and fatigue strengths yield a character band 22 capable of satisfying the fatigue and geometrical tolerance requirements of the computer printers. Similarly, the other nickel alloys of the present invention can be used to achieve the tolerances which may be required by specific printers.

The electrolyte composition is maintained constant during deposition by anode 12 dissolution. For the binary system, the preferred anode 12 comprises titanium baskets filled with cobalt chips 15 and titanium baskets filled with sulfur depolarized nickel chips 17. It should however be noted that if a different binary nickel alloy is desired, the cobalt chips 15 will be replaced with the appropriate metal. For a ternary nickel alloy, at least three titanium baskets each containing one metal will be used. No matter whether a binary system or a ternary system is used, separate rectifiers will preferably be used for each metal. This control will allow the composition of electrolyte solution 18 to be maintained at a constant level. By way of example, and not limitation, FIGS. 1 and 3 show a binary system having rectifiers or power sources 16 and 16'.

Cathode 14 comprises a cylindrical mandrel generally designated 20 capable of being rotated about its axis and of having at least one character band 22, FIG. 2a, electrodeposited thereon. In its preferred configuration, mandrel 20 comprises a plurality of circular mirror image bands 24 preferably made of stainless steel, Inconel 625, nickel, copper or titanium and circular electrical insulators 26 stacked in alternating sequence so as to generate cylindrical mandrel 20. The preferred mirror image band 24 is made of titanium. Formed along the outer circumference 28 of mandrel 20 are mirror image characters 30. Timing marks which comprise vertical lines below each character 20 can concurrently be formed during this step. Although in the preferred configuration there is interposed between each mirror image band 24 electrical insulators 26, mirror image bands 24 are electrically connected to each other so as to permit a continuous elecetronic circuit from the top mirror image band 24 to the last band 24 in the stack. By designing mandrel 20 in this manner, expensive machining time which would be required to sever one character band 22 from its adjacent band 22 would be eliminated. It should be noted that although the use of electrical insulators 26 is preferred, mandrel 20 can be formed without them.

One practical method of making mirror image bands 24 comprises electrodeposition of nickel or copper onto a stainless steel character band 22. In that the electrodeposition would exactly duplicate (in mirror image) the substrate, the characters would be as good as those on the mold.

In the preferred configuration, mandrel 20 further comprises a support structure capable of maintaining a cylindrical geometry. This support structure may either be a fluid pressurized flexible structure capable of achieving the desired geometry or in the alternative, a rigid structure such as one comprising a plurality of spokes 32 for supporting stiff mirror image bands 24. Although the above support structures are preferred, any structure capable of maintaining the desired cylindrical geometry will provide the proper mandrel formulation.

Once the electrodeposition of the anodic material is accomplished, means for releasing bands 22 will be required. In the case of a pressurized system, this can be accomplished by depressurizing mandrel 20. In the case of the rigid structure, any detent means can effect the release of bands 22.

Turning now to FIG. 3, there is shown another embodiment of electrodeposition system generally designated 10'. System 10' essentially the same as system 10; however, instead of the anodic material being deposited along the outer circumference 28 of mandrel 20, it is deposited along the interior surface 34 of mirror image band 24'. Thus, it can be seen that electrodeposition system 10' comprises anode 12' which is electrically connected to cathode 14' through conventional power source 16, 16' and electrolytic solution 18.

It should be noted that anode 12' and 12 comprise the same material, and like anode 12, anode 12' contains chips 15' and chips 17'. With the exception of the fact that cathode 14' has mirror image characters 30' located along the inner circumference 34 of mirror image band 24', and that actual support means may be designed with minor variations, the basic system 10 and 10' are the same.

Although most electrodeposition techniques will work for the present system, the preferred technique is described in copending U.S. Patent Application Ser. No. 160,336 filed June 17, 1980, entitled, "Composition Control of Electrodeposited Nickel-Cobalt Alloys" to Robert J. Walter and in the article entitled, "Composition Control and Microstructure of Electrodeposited Nickel-Cobalt Alloys" by Robert J. Walter and published in the American Electroplates Society 66th Annual Technical Conference.

Another method would comprise pulse plating whereby a conventional pulsing mechanism and power source would be used to provide the desired on/off timing. Basically, testing shows that electrodeposited nickel-cobalt samples can be electroformed in a sulfamate electrolyte wherein the Ni-Co ratio is maintained at about fifteen which in accordance with theory, will produce electrodeposited nickel-45% cobalt (EDNi-45 Co) at 40 asf current density.

It has been shown that deposit composition is very sensitive to electrolyte agitation which is needed to prevent starvation of cobalt ion at the cathode; i.e., concentration polarization. With no electrolyte agitation, the cobalt deposit composition is typically about $\frac{1}{3}$ that obtained with adequate electrolyte flow past the cathode to prevent concentration polarization. The flow rate needed across the cathode to prevent cobalt depletion can be provided by any agitation means such as spray nozzles 19, 19' and for 40 amps/ft$^2$ (asf) current density a flow rate of about 13.5 gpm/ft$^2$ is needed.

Cathodic polarization measurements performed during electrodeposition of nickel-cobalt indicate that EDNi and EDCo have the same activation polarization slopes. This means that the composition of EDNi-Co is independent of current density providing that the electrolyte agitation is adequate to prevent concentration polarization. Independence of deposit composition on current density is important because high current density areas would have the same chemistry as low current density areas.

The high current density (40 asf) at which EDNi-Co is deposited is twice that (20 asf) at which EDNi is deposited. The nickel deposition rate is limited because high current density increases the grain size in EDNi, and this in turn lowers the deposit strength. The grain size of the as-deposited EDNi-Co is however extremely small and not resolvable by optical microscopy.

Once the desired thickness of character band 22 is achieved, electrodeposition is curtailed and mandrel 20 is withdrawn from electrolyte solution. Thicknesses in the range of about 4 to about 20 mils will work; however, thicknesses in the range of about 8 to about 12 mils is most preferred with a character height of about 10 mils. Although character bands 22 can now be removed from mandrel 20, some character bands 22 are produced by first machining character bands 22 so as to remove excess backing material 36, FIG. 2b, and leave a character band 22 with a smooth back structure 38, FIG. 2a, and an overall final band 22 thickness of about 5 mils.

It should be noted that machining can be done either physically as on a lathe, or on any other cutting tool or electrochemically, as by coating the recessed areas 40, FIG. 2b, with a non-conductive material and then reversing the electrochemical process and removing excess backing material 36.

After machining, character band 22 is removed from mandrel 20 by the technique dictated by mandrel 20 configuration. If electrodeposition system 10 was used, band 22 is then inverted and then ready for use. If system 10′ is used, band inversion is not necessary.

In the most preferred character band fabrication process, machining of the excess backing material can be eliminated by first preventing electrodeposition of the desired nickel alloy onto the outer circumference 28 of mirror image band 24 by making it non-conductive, and then electrodepositing the desired nickel alloy into mirror image characters 30 until they are full. Electrodeposition on the outer circumference 28 is then permitted by making circumference 28 conductive, and completing the electrodeposition of the character band 22. Although not the only way, outer circumference 28 of mirror image band 24 can be made non-conductive by placing a non-conductive coating on it. Then once the mirror image characters 30 are filled so as to be flush with outer circumference 28, the non-conductive coating can be removed and electrodeposition of character band 22 can be completed. A second method of making outer circumference 28 non-conductive and then conductive would be through electronic circuitry.

The most practical method of eliminating a final machining operation is by starting deposition with a shield in approximate contact with circumference 28 and with holes allowing current flow only in the recessed character areas 30. These holes would be sized so that all characters are filled in at the same rate. At the moment that the characters are flush with circumference 28, the shield is removed without interrupting current flow, and the remainder of the ring is produced at a uniform rate.

Whether the machining of character band 22 is required to remove excess backing material 36, or whether the outer circumference 28 of mirror image band 24 is made non-conductive and then conductive or shielded and unshielded, the character band properties can be enhanced by placing the mandrel 20 into a second electrolytic solution whereby a conventional chromium plating technique would be used to provide an extremely hard, wear resistant chromium foundation 41 along the flat surface of character band 22.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A process for fabricating character bands used in computer printers, comprises the steps of:
   electrodepositing a metal alloy selected from the group consisting of nickel cobalt, nickel iron, nickel mangenese, nickel cobalt iron, nickel cobalt mangenese, and nickel iron mangenese onto a mandrel which comprises at least one mirror image band and wherein composition control of said electrodeposited nickel alloy is effected by
   preparing an electrolyte solution containing a predetermined amount of the preselected metal ions;
   inserting into said electrolyte solution an anode comprising at least one titanium basket for each metal in said nickel alloy;
   controlling composition of said electrolyte solution through use of a separate rectifier for each metal; and
   electrically connecting said anode to a cathodic mandrel through a
   power source;
   maintaining character band uniformity by flowing electrolyte across the surface of said mirror image band; and
   separating said electrodeposited character band from said mandrel.

2. The process of claim 1 wherein said mandrel is rotated during the electrodeposition of the selected alloy.

3. The process of claim 1 wherein accumulated excess backing material is machined so as to leave a smooth structure prior to separating said character band from said mandrel.

4. The process of claim 3 wherein a wear resistant chromium layer is electrodeposited on said smooth back structure prior to removing said character band from said mandrel.

5. The process of claim 1 which further comprises:
   preventing electrodeposition onto the outer circumference of said mirror image band;
   electrodepositing the selected nickel alloy into the mirror image characters until they are flush with outer circumference;
   making said outer circumference conductive, and
   electrodepositing said selected alloy on said mirror image band until the desired thickness is achieved.

6. The process of claim 5 wherein said means for preventing electrodeposition onto the outer circumference of said mirror image bands comprises placing a non-conductive shield in approximate contact with said outer circumference of said mirror image band and wherein said shield further comprises at least one hole aligned with each recessed character.

7. The process of claim 6 wherein electrodeposition on said outer circumference of said mirror image band is caused to occur by removing said non-conductive shield.

8. The process of claim 5 which further comprises electrodepositing a wear resistant chromium layer on said selected alloy.

9. The process of claim 1 wherein said alloy is nickel cobalt.

10. The product made in accordance with the process of claim 1.

* * * * *